US008152614B2

(12) United States Patent
Yoshizawa

(10) Patent No.: US 8,152,614 B2
(45) Date of Patent: Apr. 10, 2012

(54) GAMING MACHINE CAPABLE OF OPERATING TO INDICATE THE NUMBER OF BETS, AND GAME PLAYING METHOD

(75) Inventor: Kazumasa Yoshizawa, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 1077 days.

(21) Appl. No.: 12/040,421

(22) Filed: Feb. 29, 2008

(65) Prior Publication Data

US 2008/0220837 A1 Sep. 11, 2008

(30) Foreign Application Priority Data

Mar. 1, 2007 (JP) ..... 2007-051832

(51) Int. Cl.
*A63F 9/24* (2006.01)

(52) U.S. Cl. ..... 463/12

(58) Field of Classification Search ..... 463/12
See application file for complete search history.

(56) References Cited

U.S. PATENT DOCUMENTS 5,711,525 A 1/1998 Breeding
6,508,709 B1 * 1/2003 Karmarkar ..... 463/42
6,789,801 B2 9/2004 Snow
6,874,786 B2 4/2005 Bruno et al.
2007/0060264 A1 3/2007 Okada

FOREIGN PATENT DOCUMENTS

CN 1919392 2/2007

OTHER PUBLICATIONS

Macao Office Action with cited references; English Translation included, mailed Jun. 25, 2009.

* cited by examiner

*Primary Examiner* — Corbett B Coburn
(74) *Attorney, Agent, or Firm* — NDQ&M Wachstone LLP

(57) ABSTRACT

Baccarat is executed by placing a bet using a bet screen 70 displayed on a liquid crystal display 10. On the bet screen 70 is provided a bet-with-a-bonus button 201 in addition to an ordinary bet button 75. When the amount of bets is indicated using the bet-with-a-bonus button 201, a card game which is separate from Baccarat is executed as a bonus game subsequent to Baccarat, and the player is awarded a bonus payout based on an outcome of the bonus game. The odds when the amount of bets is indicated using the bet-with-a-bonus button 201 is set to be lower than the odds indicated using only the ordinary bet button 75.

4 Claims, 13 Drawing Sheets

| TYPE OF BET | ODDS VALUE | BONUS GAME | BONUS PAYOUT |
|---|---|---|---|
| ORDINARY BET | ORDINARY VALUE | NONE | —— |
| BET WITH BONUS | ORDINARY VALUE x0.7 OR (ORDINARY VALUE x0.7) x0.1 TO x1.0 | YES | 500 OR 100 TO 500 |

GAMING MACHINE CAPABLE OF OPERATING TO INDICATE THE NUMBER OF BETS, AND GAME PLAYING METHOD

CROSS-REFERENCE TO RELATED APPLICATIONS

This application is based upon and claims a priority from the prior Japanese Patent Application No. 2007-051832 filed on Mar. 1, 2007, the entire contents of which are incorporated herein by reference.

BACKGROUND OF THE INVENTION

1. Field of the Invention

This disclosure relates to a gaming machine capable of operating to indicate the number of bets, and a game playing method.

2. Description of Related Art

Conventionally, with games in which a side bet game is executed together with a main game, an operation of indicating the number of bets for the side bet game has been performed separately from an operation of indicating the original number of bets for the main game. Additionally, with the side bet game, it has been determined whether or not to award a bonus payout to a player thereof according to a game outcome in the main game. Furthermore, the determination to award the bonus payout to the player in the side bet game was based on a condition that a low-probability outcome is realized in the main game, since the bonus payout is relatively high (see, for example, U.S. Pat. No. 6,789,801B2, No. 5,711,525 and U.S. Pat. No. 6,874,786B2).

In the above manner, however, an opportunity for the player to be awarded the bonus payout in the side bet game is rare. Furthermore, in order to participate in the side bet game, it is necessary, as stated above, to take the trouble of indicating the number of bets for the side bet game, quite separately from indicating the original number of bets for the main game. Thus, there has been a trend that the player of the main game, who is discouraged by the above situation, will not willingly attempt to be awarded the bonus payout in the side bet game, and recedes from the side bet game.

SUMMARY OF THE INVENTION

An object of the disclosure is to provide an unprecedented, novel gaming machine and game playing method by adjusting the main game and the bonus payout lottery through a one-time indication of the number of bets.

To achieve the object of the disclosure, there is provided a gaming machine, comprising: a display device for displaying cards which are dealt in a main game; an input unit for allowing a player to enter instructions related to a progress of the main game; an operation unit for allowing the player to indicate the number of bets of one of a first type and a second type for one of "Player", "Banker", and "Tie" in the main game; a memory for storing the number of credits held by the player; and a processor programmed to execute the main game by executing processes of: when the number of bets of the first type is indicated by an operation on the operation unit, (a) displaying, upon completion of the player's performing the operation of indicating the number of bets using the operation unit, two cards which have been dealt as player cards and two cards which have been dealt as banker cards on the display device; (b) respectively determining whether or not to deal one more card about the player cards and the banker cards, which have been displayed on the display device, according to a predefined rule; (c) if it is determined to deal one more card about the player cards which have been displayed on the display device, additionally displaying the dealt one more card as the player cards on the display device; (d) if it is determined to deal one more card about the banker cards which have been displayed on the display device, additionally displaying the dealt one more card as the banker cards on the display device; (e) determining an outcome of the main game by one of the term "Player", the term "Banker", and the term "Tie", based on a combination of the two or three cards which have been displayed as the player card on the display device and a combination of the two or three cards which have been displayed as the banker card on the display device; (f) determining whether or not the player side wins for the number of bets, based on the determined outcome of the main game; and (g) if the player side wins for the number of bets, adding the number of credits calculated using a predefined odds to the number of credits in the memory and storing the sum, when, otherwise, the number of bets of the second type is indicated by an operation on the operation unit, (h) changing the odds to a lower value than the predefined odds and executing the main game; (i) randomly determining whether or not to award a bonus to the player; and (j) if it is determined to award the bonus to the player, adding the number of credits according to the bonus to the number of credits in the memory and storing the sum.

Furthermore, according to another aspect, there is provided a game playing method comprising, so as to make a main game proceed, the steps of: when a player indicates the number of bets of a first type for one of "Player", "Banker", and "Tie" in the main game, (a) dealing, upon completion of the player's indicating the number of bets, two cards as player cards and two cards as banker cards; (b) respectively determining whether or not to deal one more card about the player cards and the banker cards, according to a predefined rule; (c) if it is determined to deal one more card about the player cards, additionally dealing one more card as the player cards; (d) if it is determined to deal one more card about the banker cards, additionally dealing one more card as the banker cards; (e) determining an outcome of the main game by one of the term "Player", the term "Banker", and the term "Tie", based on a combination of the two or three cards which have been dealt as the player card and a combination of the two or three cards which have been dealt as the banker card; (f) determining whether or not the player side wins for the number of bets, based on the determined outcome of the main game; and (g) if the player side wins for the number of bets, the number of credits calculated using a predefined odds are awarded to the player, when, otherwise, the player indicates the number of bets of a second type for one of the term "Player", the term "Banker", and the term "Tie" in the main game, (h) changing the odds to a lower value than the predefined odds and executing the main game; (i) randomly determining whether or not to award a bonus to the player; and (j) if it is determined to award the bonus to the player, awarding the number of credits according to the bonus to the player.

DETAILED DESCRIPTION OF THE PREFERRED EMBODIMENTS

Figure 1:
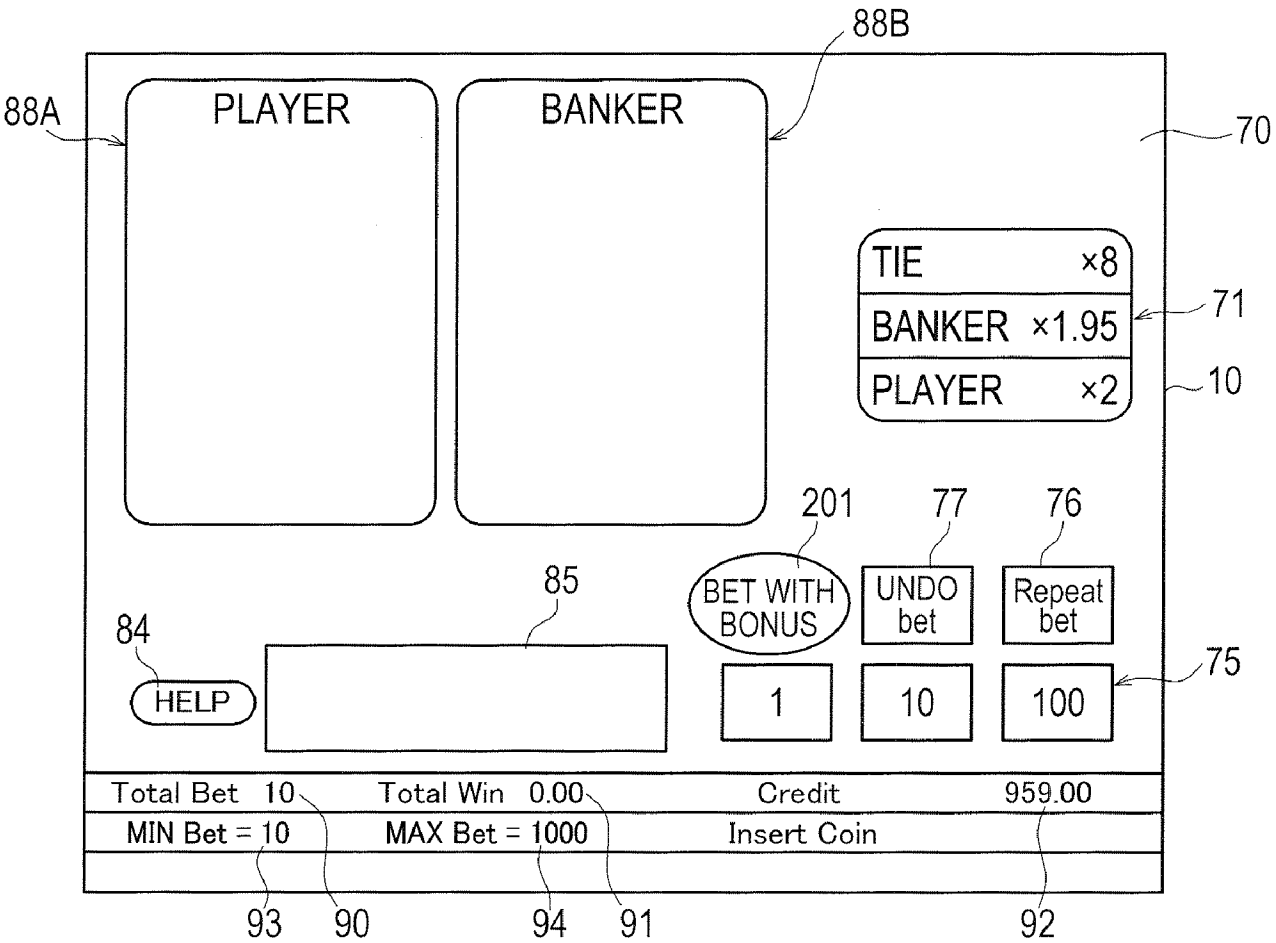
FIG. 1 is an explanatory view showing a bet screen displayed on a liquid crystal display of a terminal according to a present embodiment.

In the following, a multi-player card gaming machine according to the present invention will be described in detail referring to the drawings based on an present embodiment. Here, a card gaming machine according to the present embodiment is one type of multi-player gaming machines comprising a plurality of terminals and executes Baccarat, which is a kind of card games. Here, Baccarat is a game in which each player first expects win or loss of "Banker" and "Player" including "Tie" and bets on one of the term "Banker", the term "Player", and the term "Tie", a payout is awarded to the player based on the result of win or loss.

The card gaming machine according to the present invention has, in addition to an ordinary bet button 75, a bet-with-a-bonus button 201, such as a bet screen particularly shown in FIG. 1. When the amount of bets is indicated by both the bet-with-a-bonus button 201 and the bet button 75, a card game which is separate from Baccarat is executed as a bonus game subsequent to Baccarat, and a bonus payout is awarded to the player based on an outcome of the bonus game.

Here, odds when the amount of bets is indicated by both the bet-with-a-bonus button 201 and the bet button 75 is set to the odds, when the amount of bets is indicated only by the bet button 75, of ×0.7. In other words, the odds when the amount of bets is indicated by both the bet-with-a-bonus button 201 and the bet button 75 is set to be lower than the odds when the amount of bets is indicated only by the bet button 75.

For example, if the player bets on the term "Banker", the odds is 1.95 times when the amount of bets is indicated only by the bet button 75, otherwise, the odds is 1.65 times (=1.95 times ×0.7) when the amount of bets is indicated by both the bet-with-a-bonus button 201 and the bet button 75, which is set be lower than the odds (1.95 times) when the amount of bets is indicated only by the bet button 75. If the player bets on the term "Player", the odds is 2 times when the amount of bets is indicated only by the bet button 75, otherwise, the odds is 1.4 times (=2 times ×0.7) when the amount of bets is indicated by both the bet-with-a-bonus button 201 and the bet button 75, which is set be lower than the odds (2 times) when the amount of bets is indicated only by the bet button 75. Furthermore, if the player bets on the term "Tie", the odds is 8 times when the amount of bets is indicated only by the bet button 75, otherwise, the odds is 5.6 times (=8 times ×0.7) when the amount of bets is indicated by both the bet-with-a-bonus button 201 and the bet button 75, which is set be lower than the odds (2 times) when the amount of bets is indicated only by the bet button 75.

In the following, for simplicity of description, the phrase "when the amount of bet is indicated by both the bet-with-a-bonus button 201 and the bet button 75" may be occasionally expressed, for example, "when the amount of bet is indicated using the bet-with-a-bonus button 201".

Figure 2:
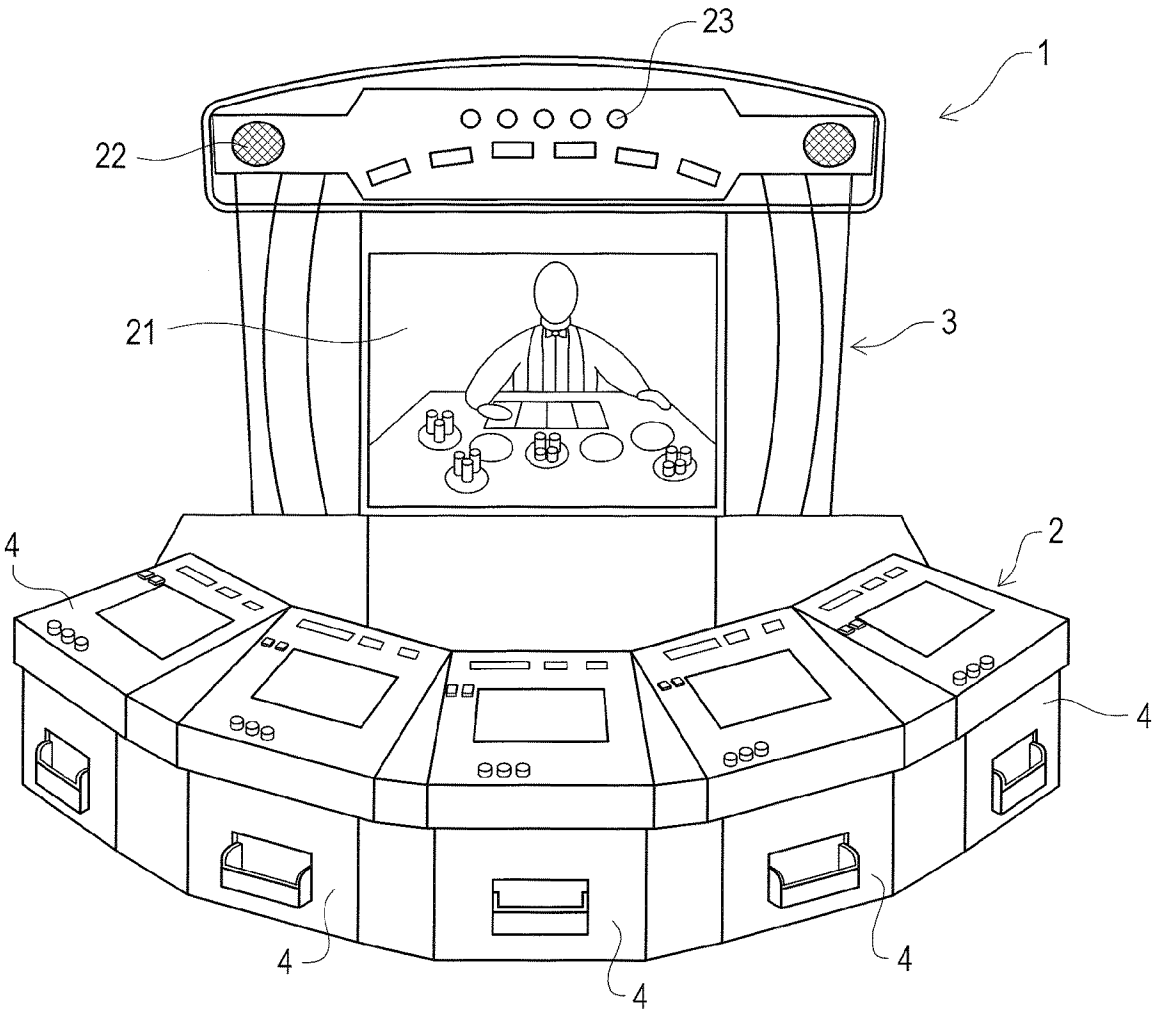
FIG. 2 is an outline view of a card gaming machine according to the present embodiment.

First, a structural overview of the card gaming machine 1 according to the present embodiment will be described, referring to FIG. 2. FIG. 2 is an outline view of the card gaming machine 1 according to the present embodiment.

The card gaming machine 1 according to the present embodiment generally comprises a table unit 2 at which the player sits and plays the game, and a panel unit 3 provided behind the table unit 2 to display animation images of the dealer.

First, the table unit 2 will be described below. The table unit 2 has a plurality (five in FIG. 2) of terminals 4 referred to as satellites arranged in generally a fan-like manner. Here, FIG. 3 is an outline view of a terminal 4 according to the present embodiment.

Figure 3:
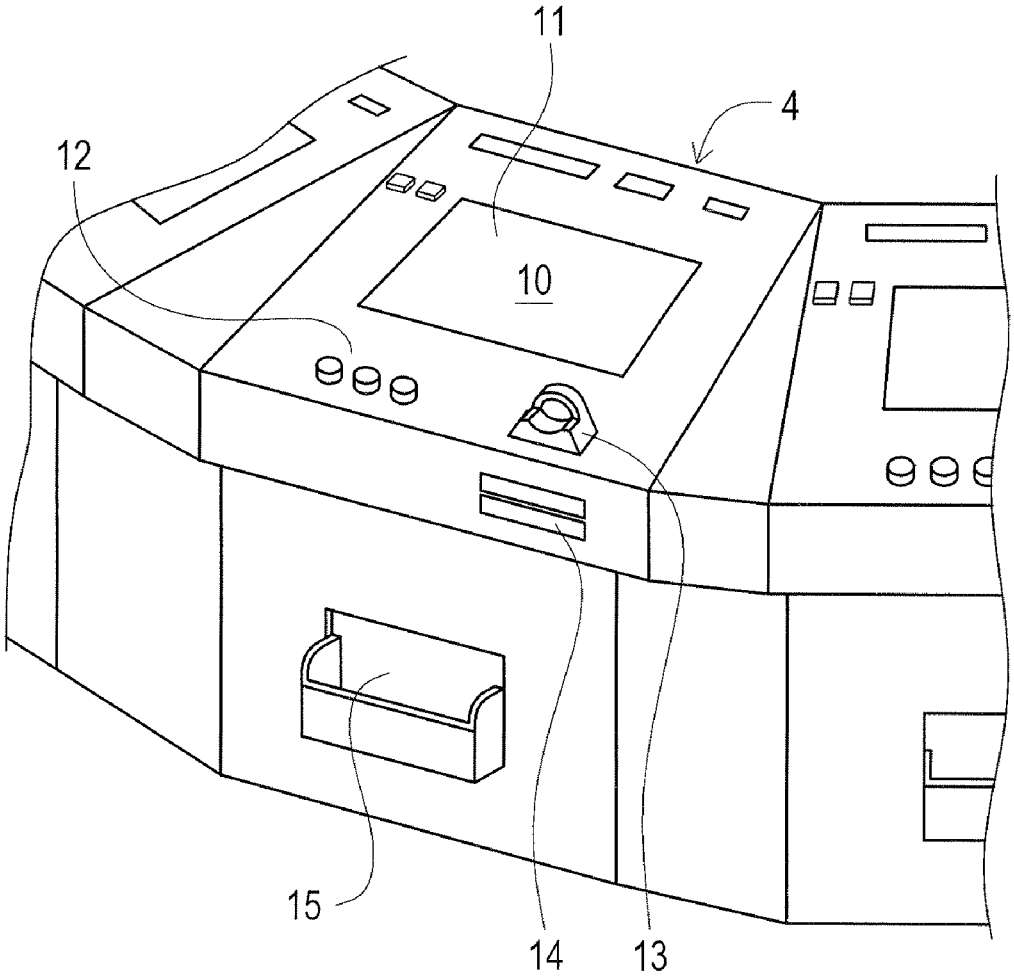
FIG. 3 is an outline view of the terminal according to the present embodiment.

As shown in FIG. 3, the terminal 4 comprises a liquid crystal display 10 for displaying the bet screen (see FIGS. 1 and 6) described below and the game outcome or the like, a touch panel 11 provided on the front face of the liquid crystal display 10 and used for selecting the buttons which are displayed on the liquid crystal display 10 when selecting the bet target and indicating the amount of bets, an operation button 12 for performing a payout operation, a coin insertion slot 13 for inserting coins or medals, a bill insertion slot 14 for inserting bills, and a coin payout opening 15 for paying out, to the player, coins or medals corresponding to the accumulated credits when a payout operation is performed.

Referring to FIG. 2 again, the panel unit 3 comprises a front display 21 for displaying images of a dealer who is dealing cards or delivering chips, and contents of the cards being dealt or the like, speakers 22 provided on the upper part of the front display 21 for outputting music or sound effects along the progress of the game, and LEDs 23 which light up when a variety of effects are performed.

Figure 8:
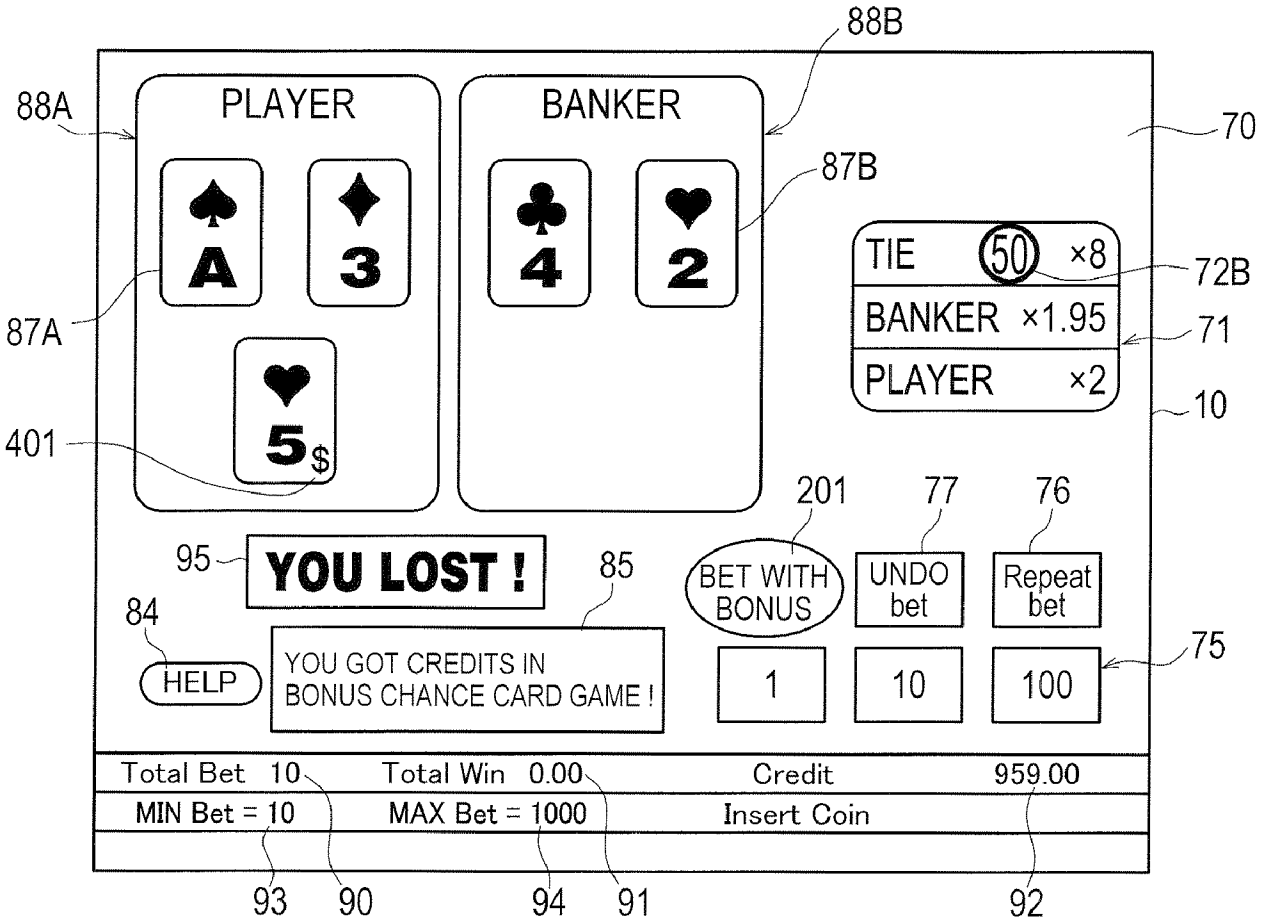
FIG. 8 is an explanatory view showing the bet screen displayed on the liquid crystal display of the terminal according to the present embodiment.

Here, the cards used in the card gaming machine 1 according to the present embodiment are same as commonly used playing cards, bearing "marks" which are composed of "suits" and "numbers" (see FIG. 8).

A "suit" indicates the symbol on the playing cards. There are four types of suits: spade, heart, diamond and club.

A "number" indicates the numeral or alphabet on the playing cards. There are 13 types of them: A (Ace, equivalent to 1), 2, 3, 4, 5, 6, 7, 8, 9, 10, J (Jack, equivalent to 11), Q (Queen, equivalent to 12), and K (King, equivalent to 13).

A "mark" indicates the type of card determined by a combination of a "suit" and a "number" of the playing card such as, for example, "A of heart", "K of spade" or the like. Then, a card deck refers to a set of 53 cards necessary for a card game, consisting of 52 cards, which is a combination of the 13 numbers and each of the four types of suits, plus a joker.

Next, a playing method of Baccarat in the card gaming machine 1 arranged as above will be described, wherein the player who is going to play the game sits in front of the terminal 4 and places a desired amount of bets, using the bet screen displayed on the liquid crystal display 10, on one of the term "Banker", the term "Player", and the term "Tie". Subsequently, images of player cards and banker cards, which have been dealt by a dealer, are displayed on the front display 21. Then, image effects identifying one of the term "Banker", the term "Player", and the term "Tie" are displayed on the front display 21, based on the types of the players cards and the bankers cards. Furthermore, a certain amount of credits, based on the amount of bets (number of credits) which has been placed and the odds value, is provided as an award at each of the terminals 4 if the player bets on the image effects identifying one. However, as stated above, the odds when the amount of bets is indicated by both the bet-with-a-bonus button 201 and the bet button 75 is set to the odds, when the amount of bets is indicated only by the bet button 75, of ×0.7. In other words, the odds when the amount of bets is indicated by both the bet-with-a-bonus button 201 and the bet button 75 is set to be lower than the odds when the amount of bets is indicated only by the bet button 75. Additionally, when the amount of bets is indicated by both the bet-with-a-bonus button 201 and the bet button 75 in particular, a card game separate from Baccarat is executed as the bonus game subsequent to Baccarat, regardless of the player's acquisition of the credits in Baccarat, and a bonus payout is awarded to the player based on the outcome of the bonus game.

Figure 4:
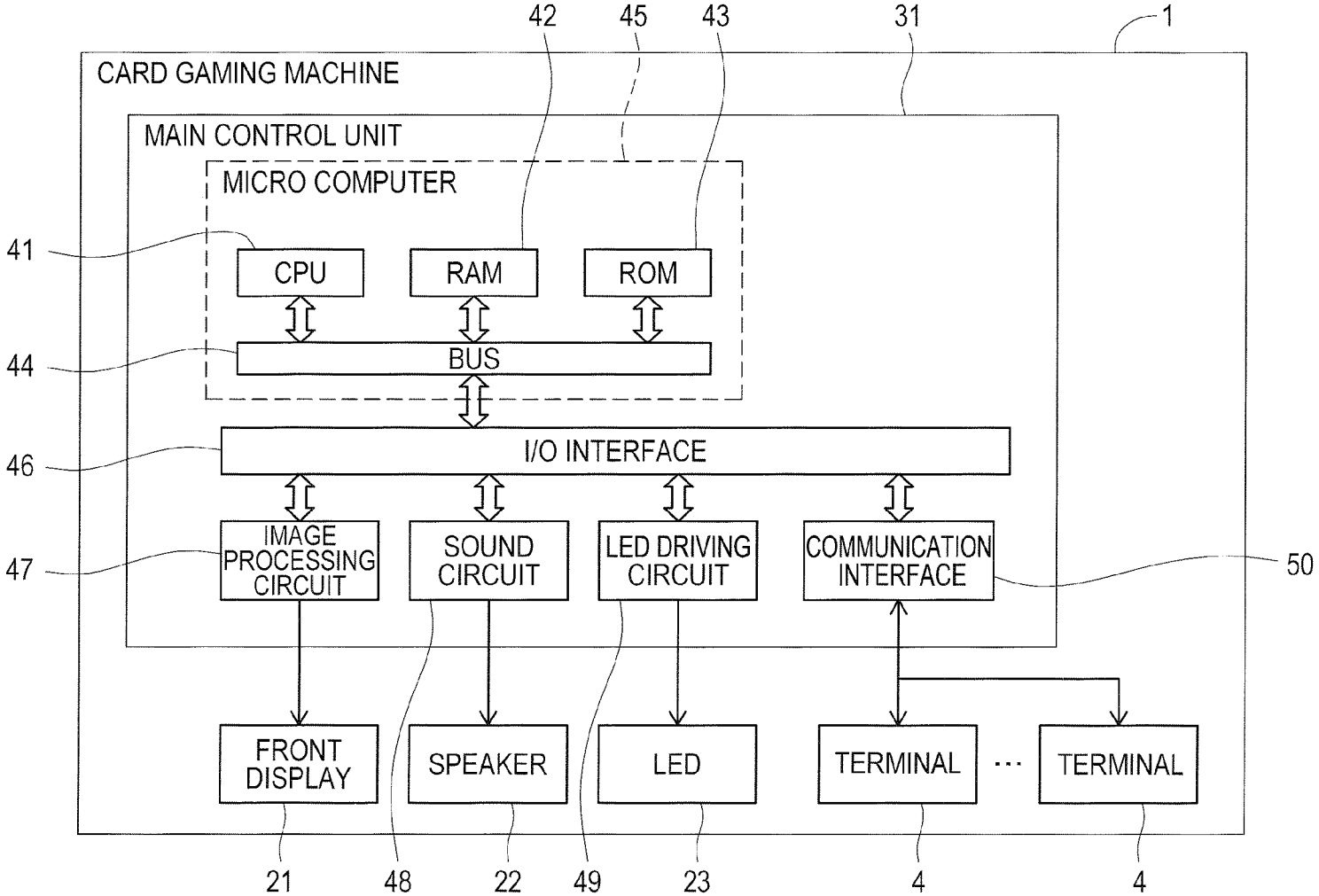
FIG. 4 is a block diagram schematically showing a control system of the card gaming machine according to the present embodiment.

Next, the arrangement related to a control system of the card gaming machine 1 will be described, referring to FIG. 4. FIG. 4 is a block diagram schematically showing the control system of the card gaming machine 1 according to the present embodiment.

The card gaming machine 1 according to the present embodiment comprises, as shown in FIG. 4, a main control unit 31, a plurality of terminals 4 connected to the main control unit 31, and a variety of peripheral devices.

The main control unit 31 is generally composed of a microcomputer 45 as the kernel comprising a CPU 41, a RAM 42, a ROM 43 and a bus 44 for transferring data mutually between these elements. The ROM 43 stores a variety of programs, data tables or the like for executing necessary processes to control the card gaming machine 1. The RAM 42 is a memory for temporarily storing a variety of data which have been operated in the CPU 41. Furthermore, the ROM 43 also stores face-up and face-down image data of the cards used as the player cards or banker cards. Particularly, with the card gaming machine 1 according to the present embodiment, a card game which is separate from Baccarat may be executed as the bonus game subsequent to Baccarat as stated above, in which case image data of a mark of "$" used in the bonus game is also stored (see FIGS. 8 and 9).

In addition, the CPU 41 is connected, via an I/O interface 46, to an image processing circuit 47, a sound circuit 48, an LED driving circuit 49, and a communication interface 50.

The main control unit 31 receives the player's bet operation information related to the amount of bets from each of the terminals 4 and determines whether or not a condition is realized to start the game of Baccarat. Then, upon starting the game of Baccarat, the main control unit 31 assigns, based on a lottery result, a predefined number pieces of cards (minimum two cards) out of the 53 playing cards to the term "Player" and the term "Banker", respectively (on the display screen, the cards are dealt to the term "Player" and the term "Banker", respectively). As the result, the win or loss (one of the term "Banker", the term "Player", and the term "Tie") is determined based on the hand (the player cards and the banker cards) of the assigned cards, and the main control unit 31 transmits the result of determination to each of the terminals 4. Subsequently, each of the terminals 4 increases or decreases the accumulated credits according to the result of win or loss received from the main control unit 31.

Furthermore, the main control unit 31 identifies the terminal 4 at which the player's bet operation has been performed on both the bet-with-a-bonus button 201 and the bet button 75 according to the bet operation information received from each of the terminals 4, for the identified terminal 4, regardless of the win or loss result of Baccarat, and determines whether or not a card which is marked with a mark of "$" is one of the cards which are dealt to the player's bet target. For example, if the player bets on the term "Player", the main control unit 31 determines whether or not a card which is marked with a mark of "$" is one of the cards (the player cards) assigned to the term "Player". If the player bets on the term "Banker", the main control unit 31 determines whether or not a card which is marked with a mark of "$" is one of the cards (the banker cards) assigned to the term "Banker". If the player bets on the term "Tie", the main control unit 31 determines whether or not a card which is marked with a mark of "$" is one of the cards (the player cards or the banker cards) assigned to the term "Player" or the term "Banker". Then the main control unit 31 transmits the determination result to the terminal 4. Subsequently, based on the result of win or loss for the bonus which is received from the main control unit 31, the terminal 4 increases the accumulated credits by amount of the bonus payout, only when a card which is marked with a mark of "$" is one of the cards which are dealt to the player's bet target.

In addition, the main control unit 31 also outputs image signals to be displayed on the front display 21, and controls driving of the speakers 22 and the LEDs 23.

Figure 5:
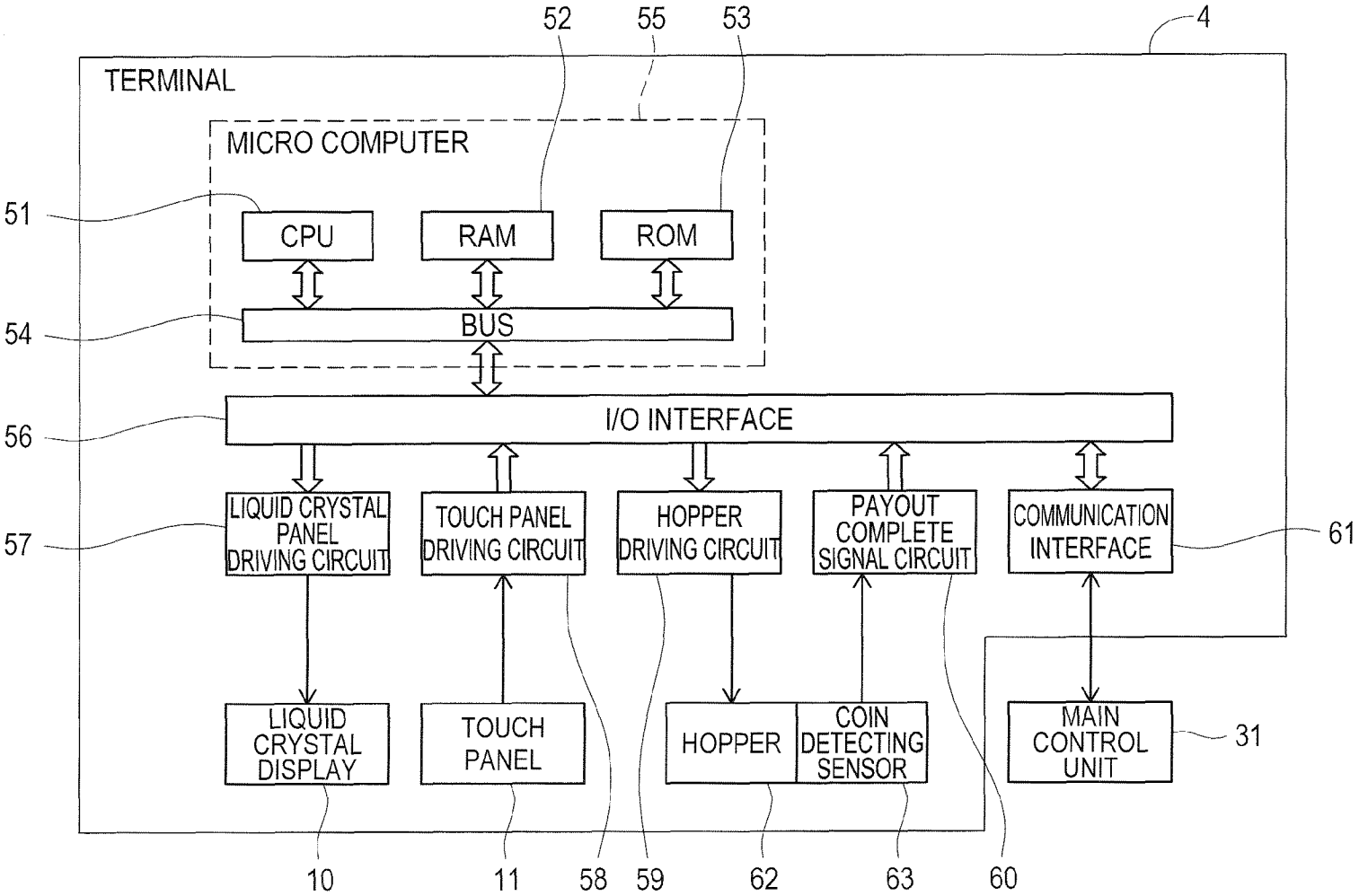
FIG. 5 is a block diagram schematically showing a control system of the terminal according to the present embodiment.

Next, the arrangement related to a control system of the terminal 4 will be described, referring to FIG. 5. FIG. 5 is a block diagram schematically showing the control system of the terminal 4 according to the present embodiment.

The terminal 4 according to the present embodiment is generally composed of a microcomputer 55 as the kernel comprising a CPU 51, a RAM 52, a ROM 53 and a bus 54 for transferring data mutually between these elements, as shown in FIG. 5. ROM 43 includes a variety of programs, data tables or the like stored therein for executing necessary processes to control the terminal 4. The RAM 52 is a memory for temporarily storing a variety of data which have been operated in the CPU 51, such as the number of credits (that is, the number of credits held by the player at the terminal 4) currently accumulated on the terminal 4, the bet target on which the player placed a bet, the bet type (whether or not the bet-with-a-bonus button 201 has been used), the amount of bets (number of credits) which has been placed on the bet target or the like.

In addition, the CPU 51 is connected, via an I/O interface 56, to a liquid crystal panel driving circuit 57, a touch panel driving circuit 58, a hopper driving circuit 59, a payout complete signal circuit 60, and a communication interface 61. Furthermore, a liquid crystal display 10 is connected to the liquid crystal panel driving circuit 57, a touch panel 11 is connected to the touch panel driving circuit 58, a hopper 62 is connected to the hopper driving circuit 59, and a coin detecting sensor 63 is connected to the payout complete signal circuit 60, respectively. Additionally, the main control unit 31 is connected to the communication interface 61.

Based on operation information which is output from the touch panel 11, the CPU 51 calculates the amount of bets (number of credits) placed by the player, then, together with information about whether or not the bet operation has been performed using the bet-with-a-bonus button 201 (type of bet), stores them into the RAM 52 and transmits them to the main control unit 31. Furthermore, the CPU 51 increases or decreases the accumulated credits according to the win or loss transmitted from the main control unit 31. Additionally, when the player has performed the bet operation using the bet-with-a-bonus button 201, the CPU 51 increases the accumulated credits according to the win or loss for the bonus transmitted from the main control unit 31.

In addition, the CPU 51 also outputs image signals to be displayed on the liquid crystal display 10, and controls payout of coins from the coin payout opening 15 by the hopper 62 and the coin detecting sensor 63.

Next, a bet screen 70 which is displayed on the liquid crystal display 10 of the terminal 4 when Baccarat is played on the card gaming machine 1 according to the present embodiment will be described, referring to FIG. 1 and FIGS. 6 to 8. FIG. 1 and FIGS. 6 to 8 are diagrams showing the bet screen 70 displayed on the liquid crystal display 10 of the terminal 4. Here, with the card gaming machine 1 according to the present embodiment, the player uses the bet screen 70 and the touch panel 11 to perform a bet operation of placing a certain amount of credits. With regard to this, the bet operation includes an ordinary bet operation which is performed only on the bet button 75 without using the bet-with-a-bonus button 201, and a bet-with-a-bonus operation which is performed on both the bet-with-a-bonus button 201 and the bet button 75.

As shown in FIG. 1, and FIGS. 6 to 8, the bet screen 70 comprises a player card display area 88A for displaying images 87A (see FIG. 8) of the cards dealt to the term "Player", a banker card display area 88B for displaying images 87B (see FIG. 8) of the cards dealt to the term "Banker", a chip display area 71 for displaying a image 72 (see FIGS. 6 to. 8) of the chips which have been bet, and an information display area for displaying a variety of operation buttons and information of the player.

Here, the image 72 of chips (see FIGS. 6 to 8) includes an image 72A of chips (see FIG. 6) which is displayed for a bet-with-a-bonus operation performed on both the bet-with-a-bonus button 201 and the bet button 75, and an image 72B of chips (see FIGS. 7 to 8) which is displayed for an ordinary bet operation performed only on the bet button 75 without using the bet-with-a-bonus button 201. With regard to this, both images 72A and 72B of chips are distinctly displayed using different colors or the like, although not shown.

Here, the player card display area 88A is a display area for displaying the images 87A (see FIG. 6) of the cards dealt to the term "Player". The banker card display area 88B is a display area for displaying the images 87B (see FIGS. 7 to 8) of the cards dealt to the term "Banker".

Figure 6:
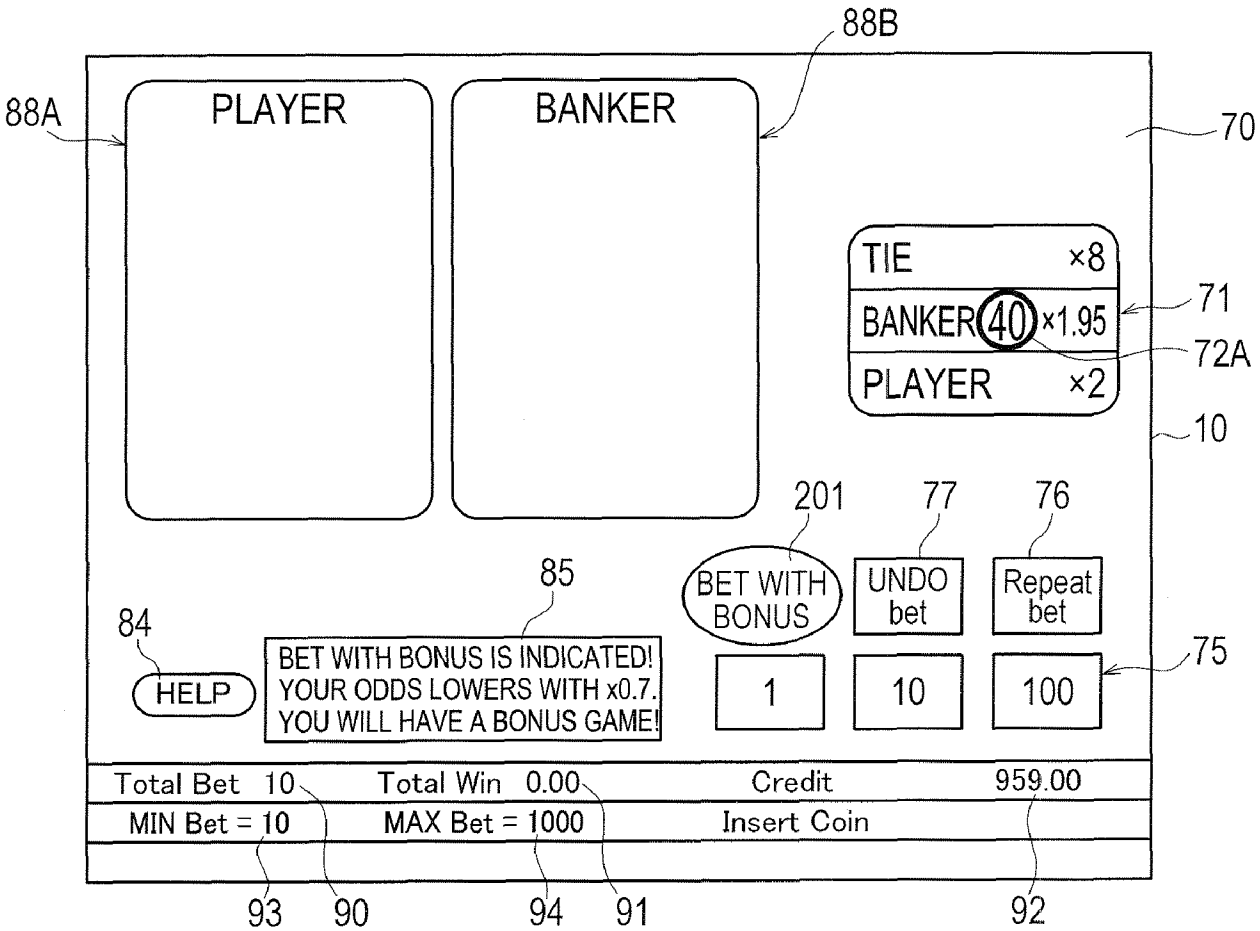
FIG. 6 is an explanatory view showing the bet screen displayed on the liquid crystal display of the terminal according to the present embodiment.
Figure 7:
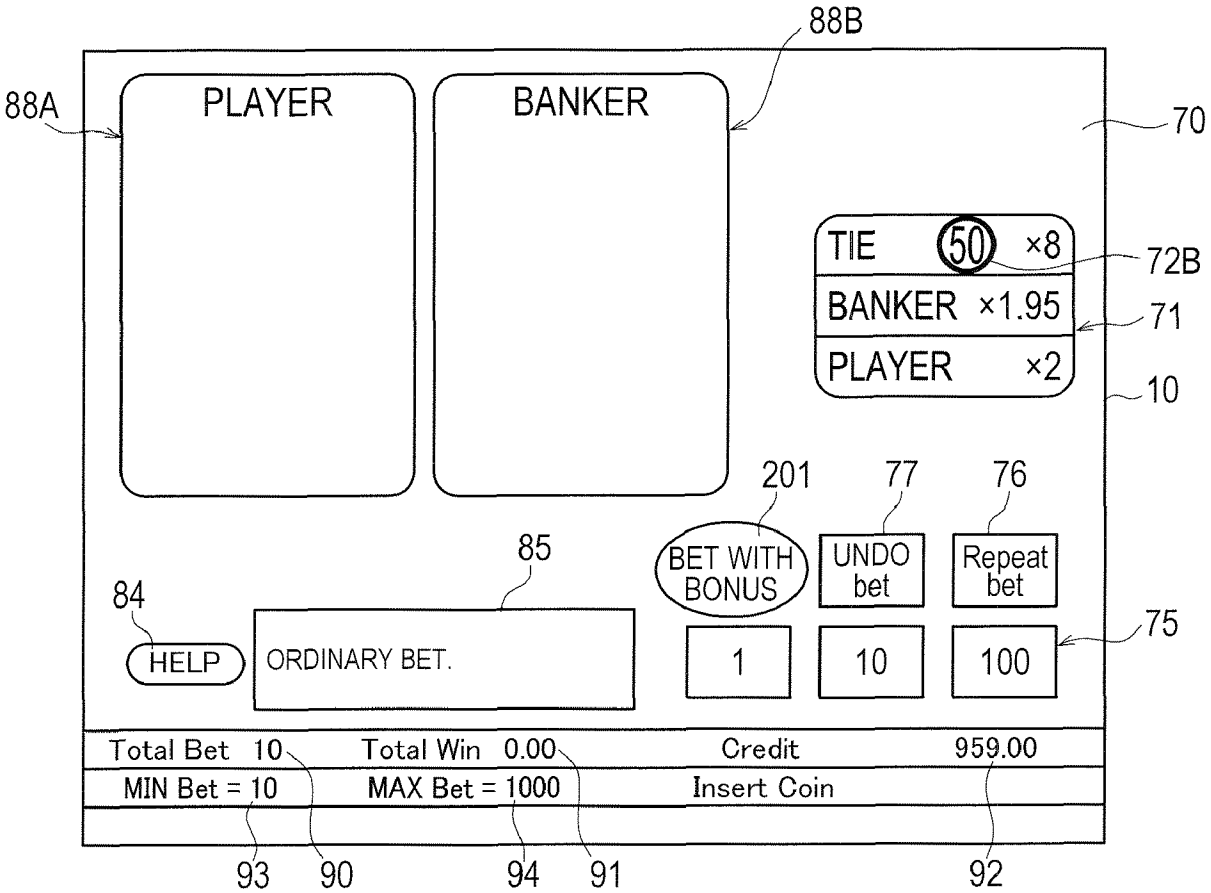
FIG. 7 is an explanatory view showing the bet screen displayed on the liquid crystal display of the terminal according to the present embodiment.

The chip display area 71 displays the image 72 of chips corresponding to the amount of bets placed by the player (for example, chips corresponding to 40 or 50 credits are bet in FIGS. 6 to 8). The player then selects the amount of bets using the bet button 75, determines the amount of bets by touching the chip display area 71. The terminal 4 transmits the determined amount of bets to the main control unit 31.

Furthermore, the chip display area 71 is divided to each area of the term "Player", the term "Banker", and the term "Tie". Each of the areas displays the odds when the amount of bets is indicated only by the bet button 75. The player then determines one of the term "Player", the term "Banker", and the term "Tie" to the player's bet target, by touching one of areas in the chip display area 71. The terminal 4 transmits the determined player's bet target to the main control unit 31.

In addition, a plurality of the bet buttons 75 (three in the present embodiment, i.e., "one credit", "10 credits", and "100 credits") are provided on the lower side of the chip display area 71. Then, the player can select the amount of bets to be placed in the current game by touching the bet button 75.

Additionally, the bet-with-a-bonus button 201 is provided above the bet button 75. The player can indicate the amount of bets using the bet button 75 as a bet-with-a-bonus operation by touching the bet-with-a-bonus button 201 once.

However, if the amount of bets is indicated by using only the bet button 75 without touching the bet-with-a-bonus button 201, the operation turns out to be an ordinary bet operation.

Furthermore, a Repeat bet button 76 and an UNDO bet button 77 are provided above the bet button 75. The player can place a bet which is the same amount of bets as the previous game by touching the Repeat bet button 76. In addition, a bet operation performed once can be canceled by touching the UNDO bet button 77. Furthermore, a bet-with-a-bonus operation can be canceled by touching the UNDO bet button 77.

In addition, a HELP button 84 is provided on the lower side of the player card display area 88A. The HELP button 84 is a button to be touched when displaying operation instructions of the card gaming machine 1 on the liquid crystal display 10. Additionally, a message area 85 for displaying messages that support the progress of the game is provided on the right hand side of the HELP button 84.

On the message area 85, messages such as "BET WITH BONUS IS INDICATED! YOUR ODDS LOWER WITH ×0.7. YOU WILL HAVE A BONUS GAME!" are displayed, as shown in FIG. 6 while a bet-with-a-bonus operation is being performed. While, on the other hand, an ordinary bet operation is being performed, message such as "ORDINARY BET." is displayed.

At the lower part of the bet screen 70, a bet amount display area 90 for displaying the amount of bets currently placed by the player, an acquisition amount display area 91 for displaying the amount provided to the player as an award in the game, a held credit display area 92 for displaying the number of credits currently held by the player, a lower-limit-of-bet-amount display area 93 displaying the lower limit of the amount of bets that can be placed by the player, and an upper-limit-of-bet-amount display area 94 displaying the upper limit of the amount of bets that can be placed by the player, as shown in FIG. 7.

Additionally, as shown in FIG. 8, a win-or-loss display area 95 displaying the win or loss of the player for the bet in the current game is provided on the lower side of the player card display area 88A. Here, if the player side wins for the bets, a character string "YOU WON!" is displayed on the win-or-loss display area 95. Furthermore, a character string "YOU LOST!" is displayed on the win-or-loss display area 95 when the player side loses for the bet are provided.

Next, a main screen 101 displayed on the front display 21 will be described referring to FIG. 9, when playing Baccarat in the card gaming machine 1 according to the present embodiment.

Figure 9:
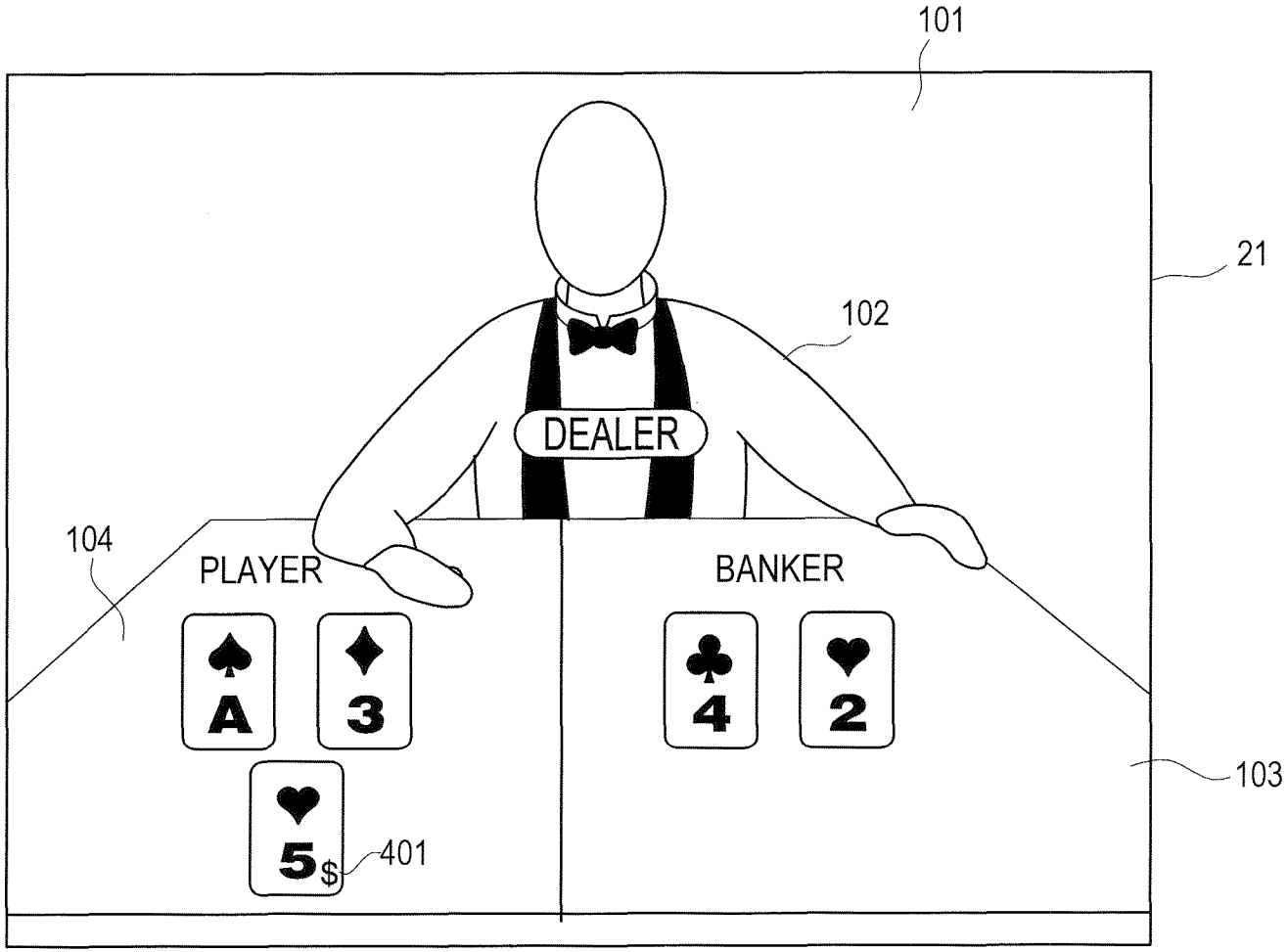
FIG. 9 is an explanatory view showing a main screen displayed on a front display according to the present embodiment.

FIG. 9 is a diagram showing the main screen 101 displayed on the front display 21. Here, with the card gaming machine 1 according to the present embodiment, an image 102 of the dealer animated to perform dealing of the cards along the progress of the game is displayed on the main screen 101 in order to improve the sense of reality of the game.

A banker cards display area 103 displaying an image of the cards (the banker cards) dealt to the term "Banker" is provided at the right part of the main screen 101. Furthermore, a player cards display area 104 displaying an image of the cards (the player cards) dealt to the term "Player" is provided at the left part of the main screen 101. Accordingly, the player can identify the type of cards dealt to the term "Banker" and can identify the type of cards dealt to the term "Player", referring to the main screen 101.

Figure 10:
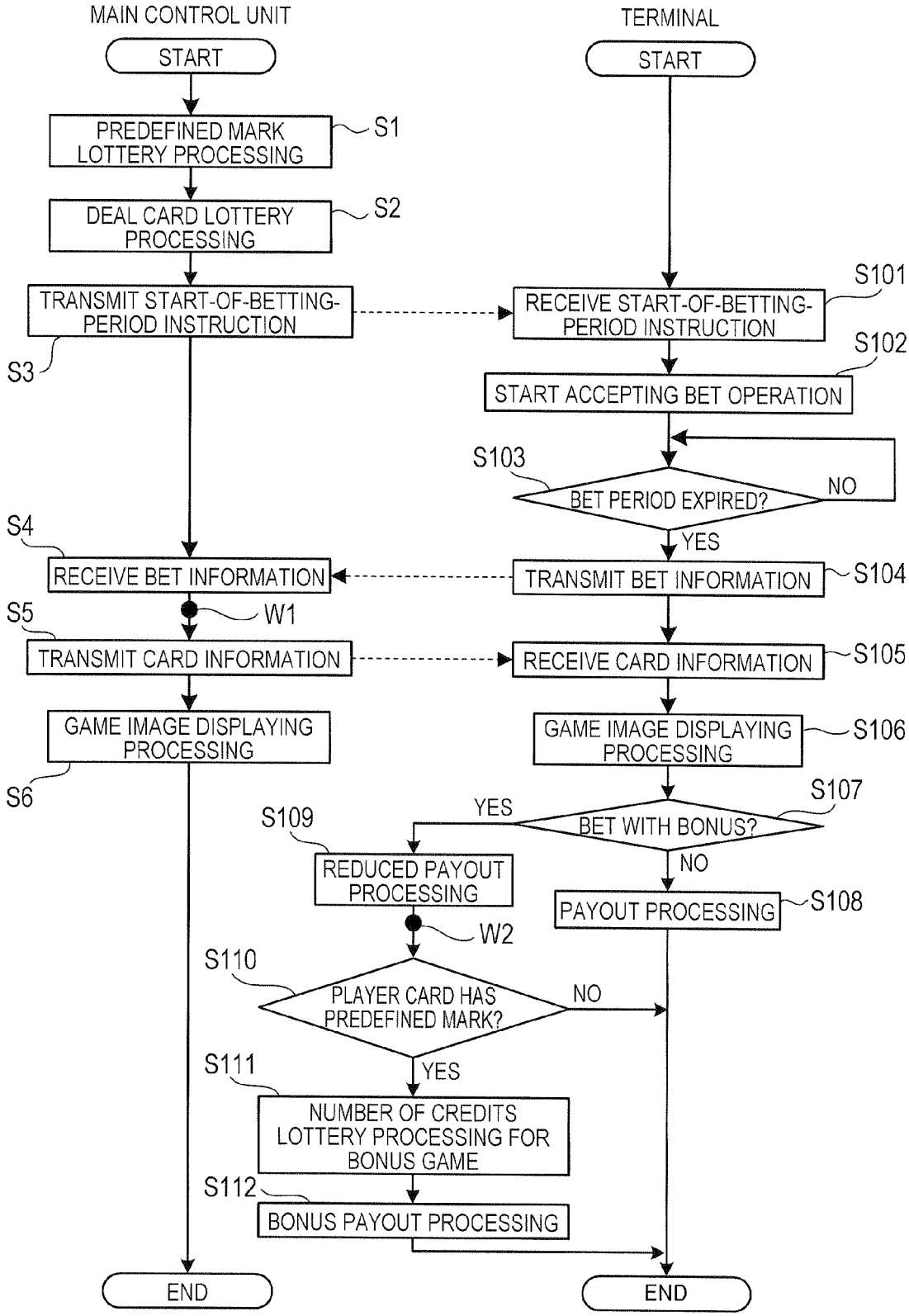
FIG. 10 is a flow chart of a game processing program in the card gaming machine according to the present embodiment.

Next, a game processing program executed by the CPU 41 of the main control unit 31 and a game processing program at the terminal side executed by the CPU 51 of the terminal 4, respectively in the card gaming machine 1 according to the present embodiment, will be described, referring to FIG. 10. Here, respective programs shown as a flow chart in FIG. 10 are stored in the RAM 42 or the ROM 43 provided in the main control unit 31, or the RAM 52 or the ROM 53 provided in the terminal 4, and are executed by the CPU 41 or the CPU 51.

First, the game processing program executed by the main control unit 31 will be described, referring to FIG. 10. In step (abbreviated to S hereafter) 1, the CPU 41 executes a predefined mark lottery processing. Specifically, assuming that there are N cards (N=53 in Baccarat) to be used in the game, a number (deal order) within the range of 1 to N is associated with each one of the cards. Then, a plurality (for example, five) of number within the range of 1 to N are drawn. The each card associated with the drawn numbers is marked with a mark 401 of "$" (see FIGS. 8 and 9). Furthermore, in S2, the CPU 41 executes a deal card lottery processing to draw cards which are associated with the term "Player" and the term "Banker". Specifically, according to the number (deal order) associated of S1, each couple of cards are associated to the term "Player" and the term "Banker" respectively. In other words, the player cards are dealt to the term "Player" and the banker cards are dealt to the term "Banker". With regard to this, one more card is able to be associated with the term "Player" and the term "Banker" respectively, according a rule of Baccarat.

Subsequently, in S3, the CPU 41 transmits, to each of the terminals 4, an instruction to start a betting period for accepting the player's bet operation.

Next, in S4, the CPU 41 receives bet information transmitted from each of the terminals 4. Here, the bet information includes information relating to the player's bet target and the amount of bets (number of credits) placed by the player, and information relating to the type of bet (whether or not the bet operation has been performed using the bet-with-a-bonus button 201) placed by the player. In addition, the received bet information of each terminal 4 is temporarily stored in the RAM 42.

Subsequently, in S5, the CPU 41 transmits, to each of the terminals 4, information relating to the each cards associated (dealt) to the term "Player" and the term "Banker" at each of the terminals 4 (for example, information about the marks such as "7 of heart", "A of spade", or having a mark of "$" or not), based on the lottery result of the deal card lottery processing of S2. With regard to this, the CPU 41 compares the cards associated (dealt) to the term "Player" with the card associated (dealt) to the term "Banker" and determines the win or loss. Furthermore, based on the determination result of win or loss and the bet information transmitted of S4, the CPU 41 determines whether or not the player's side wins for the bet. The CPU 41, then, transmits the information including the determined result of the player's side to each of the terminals 4. Then, in S6, the image 102 of the dealer who deals each card associated respectively to the term "Player" and the term "Banker" is displayed on the front display 21 as the main screen 101 (see FIG. 9). Then, the CPU 41 terminates the game processing program.

Next, the game processing program executed by the terminal 4 will be described, referring to FIG. 10. In S101, the CPU 51 receives the instruction to start the betting period from the main control unit 31.

Subsequently, in S102, the CPU 51 displays the bet screen 70 (see FIGS. 1, 6 to 8) on the liquid crystal display 10, and identifies the player's bet target and the amount of bets (the number of credits) which has been placed, based on operation information from the touch panel 11. In addition, the CPU 51 identifies the type of bet placed by the player (whether or not a bet operation has been performed using the bet-with-a-bonus button 201). Furthermore, the CPU 51 displays the images 72A and 72B of chips on the bet screen 70 in a distinct manner, based on the identified type of bet.

Next, in S103, the CPU 51 determines whether or not the betting period has expired. Specifically, it is determined whether or not a predefined time length (e.g. 20 sec) has passed since accepting the bet operation was started in S102.

If it is determined that the betting period has not expired (S103: NO), accepting the bet operation is continued. If, on the other hand, it is determined that the betting period has expired (S103: YES), the process flow proceeds to S104.

In S104, the CPU 51 transmits the bet information to the main control unit 31. Here, the bet information includes the information relating to the player's bet target and the amount of bets (the number of credits) placed by the player, or the information relating to the type of bet (whether or not the bet operation has been performed using the bet-with-a-bonus button 201) placed by the player.

Additionally, in S105, the CPU 51 receives the information of the each card associated (dealt) to the term "Player" and the term "Banker" (information such as the type of marks, having a mark of "$" or not, the determination result of the player side) from the main control unit 31. Then, in S106, the CPU 51 displays the cards associated with the bet screen 70, based on the information of the each card received in S105.

Then, in S106, the CPU 51 displays, on the liquid crystal display 10, the determination result of the player side of the player who is playing at the terminal 4, based on the determination result of the player side received in S105. Specifically, if the player's side wins for the bet, a character string "YOU WON!" is displayed on the win-or-loss display area 95 of the bet screen 70 (see FIG. 8). Furthermore, a character string "YOU LOST!" is displayed if the player's side loses for the bet.

Subsequently, in S107, the CPU 51 determines whether or not a bet-with-a-bonus operation has been performed, based on the bet information transmitted in S104. Here, also in this determination, it is determined that a bet-with-a-bonus operation has been performed when a bet has been placed using the bet-with-a-bonus button 201. Then, if it is determined that no bet-with-a-bonus operation has been performed (S107: NO), the process flow proceeds to S108. In S108, an ordinary payout is made. Specifically, credits 1.95 times the amount of bets is paid to the player if the player, betting on the term "Banker", wins for the bet. Credits 2 times the amount of bets is paid to the player if the player, betting on the term "Player", wins for the bet. Credits 8 times the amount of bets is paid to the player if the player, betting on the term "Tie", wins for the bet. However, if the player side loses for the bet, nothing is paid to the player. Then, the CPU 51 terminates the game processing program.

If, on the other hand, it is determined that a bet-with-a-bonus operation has been performed (S107: YES), the process flow proceeds to S109. In S109, payout is made with the amount of the award changed from the case of S108. Specifically, credits 1.65 times (1.95 times ×0.7) the amount of bets is paid to the player if the player, betting on the term "Banker", wins for the bet. Credits 1.4 times (2 times ×0.7) the amount of bets is paid to the player if the player, betting on the term "Player", wins for the bet. Credits 5.6 times (8 times ×0.7) the amount of bets is paid to the player if the player, betting on the term "Tie", wins for the bet. If the player side loses for the bet, nothing is paid to the player. Then, the process flow proceeds to S110, the CPU 51 executes the bonus game.

In S110, the CPU 51 determinates whether or not a card which is marked with a mark 401 of "$" is one of the cards which are dealt to the player's bet target on the bet screen 70. Specifically, the CPU 51 determinates whether or not a card which is marked with a mark 401 of "$" is one of the cards which are dealt to the term "Banker" if the player bets on the term "Banker". The CPU 51 determinates whether or not a card which is marked with a mark 401 of "$" is one of the cards which are dealt to the term "Player" if the player bets on the term "Player". The CPU 51 determinates whether or not a card which is marked with a mark 401 of "$" is one of the cards which are dealt to the term "Banker" or "Player" if the player bets on the term "Tie". Then, if it is determined that no card which is marked with a mark 401 of "$" is one of the cards which are dealt to the player's bet target (S110: NO), the CPU 51 terminates the game processing program. If, on the other hand, it is determined that a card which is marked with a mark 401 of "$" is one of the cards which are dealt to the player's bet target (S110: YES), the process flow proceeds to S111.

Subsequently, in S111, a number of credits lottery processing for the bonus game executed by the CPU 51. Then, a number of credits within the range of 100 to 500 is drawn in the number of credits lottery processing for the bonus game. The lottery may be executed either by hardware or software. The lottery may be executed by the main control unit 31, in this case, the lottery result is included in the information of S5 or S105. Then, in S112, the CPU 51 executes a bonus payout processing to add and store, in the RAM 53, the number of credits of S111, and provide it to the player. The CPU 51 displays a character string "YOU GOT CREDITS IN BONUS CHANCE CARD GAME!" on the message area 85 of the bet screen 70 as shown in FIG. 8.

In this manner, with regard to the bonus game which has been executed subsequent to Baccarat, the game processing program executed by the CPU 51 of the terminal 4 is terminated.

Note that the present invention is not limited to the above examples, and various kinds of improvement or modification are possible without deviating from the scope of the present invention.

For example, in the present embodiment, the number of credits provided to the player who won in the bonus game may be fixed to 500 credits or the like, instead of the lottery in S111 of FIG. 10.

Additionally, in Baccarat with the present embodiment, when the player indicates the amount of bets using the bet-with-a-bonus button 201, each odds for which may be changed (it is fixed at 1.95 times ×0.7, 2 times ×0.7, or 8 times ×0.7 in the above example). Therefore, it may be arranged such that, for example, the main control unit 31 executes a game processing program shown in FIG. 11 at a time point W1 located in the middle between S4 and S5 of the game processing program shown in FIG. 10. In other words, when the bet information is received by S4 of the game processing program shown in FIG. 11, the process flow proceeds to S31 of the game processing program shown in FIG. 11 where the CPU 41 of the main control unit 31 determines whether or not a bet-with-a-bonus operation has been performed. This determination is based on the bet information received from each of the terminals 4, and it is determined that a bet-with-a bonus operation has been performed if a bet operation has been performed using the bet-with-a-bonus button 201. Here, for a terminal 4 which is determined that no bet-for-a-bonus operation has been performed thereon (S31: NO), the process flow returns to the game processing program shown in FIG. 10 and proceeds to S5 without doing anything. On the other hand, for a terminal 4 which is determined that a bet-with-a-bonus operation has been performed thereon (S31: YES), the process flow proceeds to S32.

In S32, the CPU 41 acquires, by lottery, a numerical formula within the range of ×0.1 to ×1.0. The lottery may be executed either by hardware or software. Subsequently, in S33, the CPU 41 includes the numerical formula acquired in S32 into the information of the each card (see S5 of FIG. 10), then the process flow returns to the game processing program shown in FIG. 10 and proceeds to S5.

Figure 11:
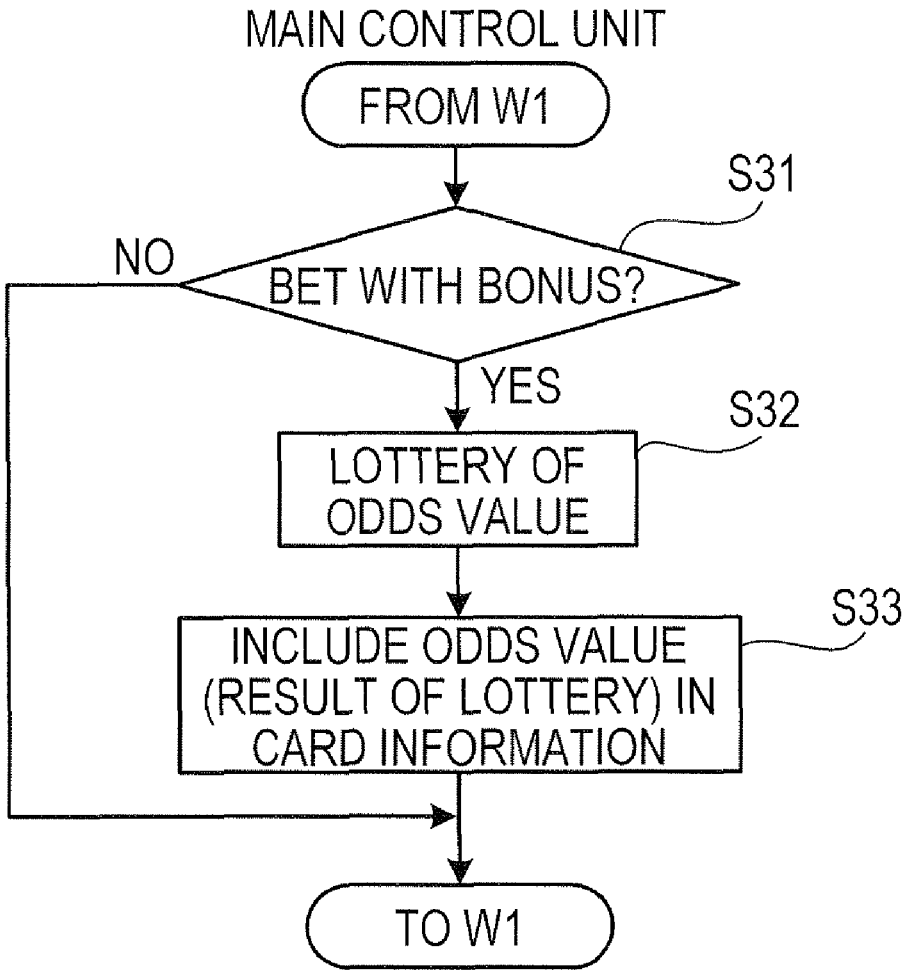
FIG. 11 is a flow chart of a game processing program in the card gaming machine according to the present embodiment.

In this manner, when the main control unit 31 executes the game processing program shown in FIG. 11, the CPU 51 of each of the terminals 4 displays, in S105 of the game processing program shown in FIG. 10, the numerical formula included in the information of the each card on the message area 85 of the bet screen 70. For example, if the numerical formula included in the information of the each card is ×0.5, a character string "BET WITH BONUS IS INDICATED! YOUR ODDS LOWER WITH ×0.7×0.5. YOU WILL HAVE A BONUS GAME!" is displayed on the message area 85 of the bet screen 70. Furthermore, when the process flow proceeds to S109 of the game processing program shown in FIG. 10, the CPU 51 of each of the terminals 4 executes payout of an award based on the odds value multiplied by the numerical formula included in the information of the each card.

In addition, the present embodiment may be limited such that the bonus game executed subsequent to Baccarat is executed only if the player side wins for the player's bet in Baccarat.

Figures 12, 13:
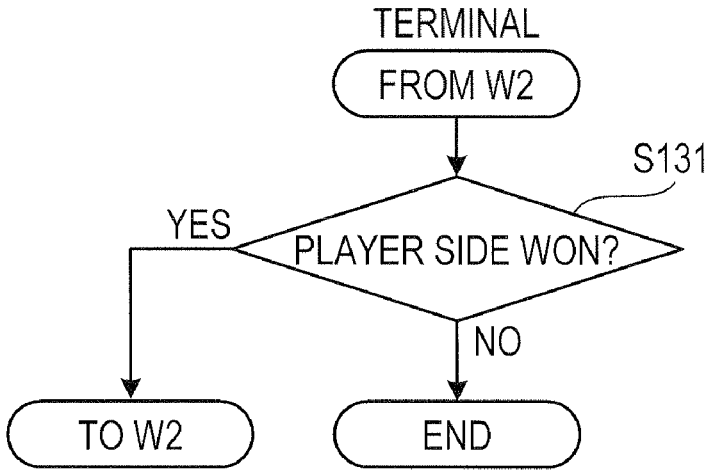
FIG. 12 is a flow chart of a game processing program in the card gaming machine according to the present embodiment.
FIG. 13 is a table showing the difference between an ordinary bet operation and a bet-with-a-bonus operation.

Therefore, it may be arranged such that, for example, the terminal 4 executes a game processing program shown in FIG. 12 at a time point W2 located in the middle between S109 and S110 of the game processing program shown in FIG. 10. In other words, upon executing a reduced payout processing of S109 of the game processing program shown in FIG. 10, the process flow proceeds to S131 shown in FIG. 12, the CPU 51 of each of the terminals 4 determinates whether or not the player side wins for the player's bet in Baccarat of the terminal 4. This determination is based on the information of the each card of S5 or S105, including the determination result of the player side. Here, if it is determined that the player side has won for the player's bet in Baccarat of the terminal 4 (S131: YES), the process flow proceeds to S110 of the game processing program shown in FIG. 10, and the CPU 51 executes the bonus game of the terminal 4. If, on the other hand, it is determined that the player side has not won (defeat) for the player's bet in Baccarat of the terminal 4 (S131: NO), the game processing program executed by the terminal 4 is subsequently terminated.

In this manner, if each of the terminals 4 executes the game processing program shown in FIG. 12, the bonus game executed subsequent to Baccarat is executed only on the terminal 4 at which the player side won in Baccarat.

Additionally, with the present embodiment, the card gaming machine 1 which executes Baccarat and the bonus game may be a gaming machine on which the above-mentioned control unit 31 and the terminal 4 are integrated.

Figure 14:
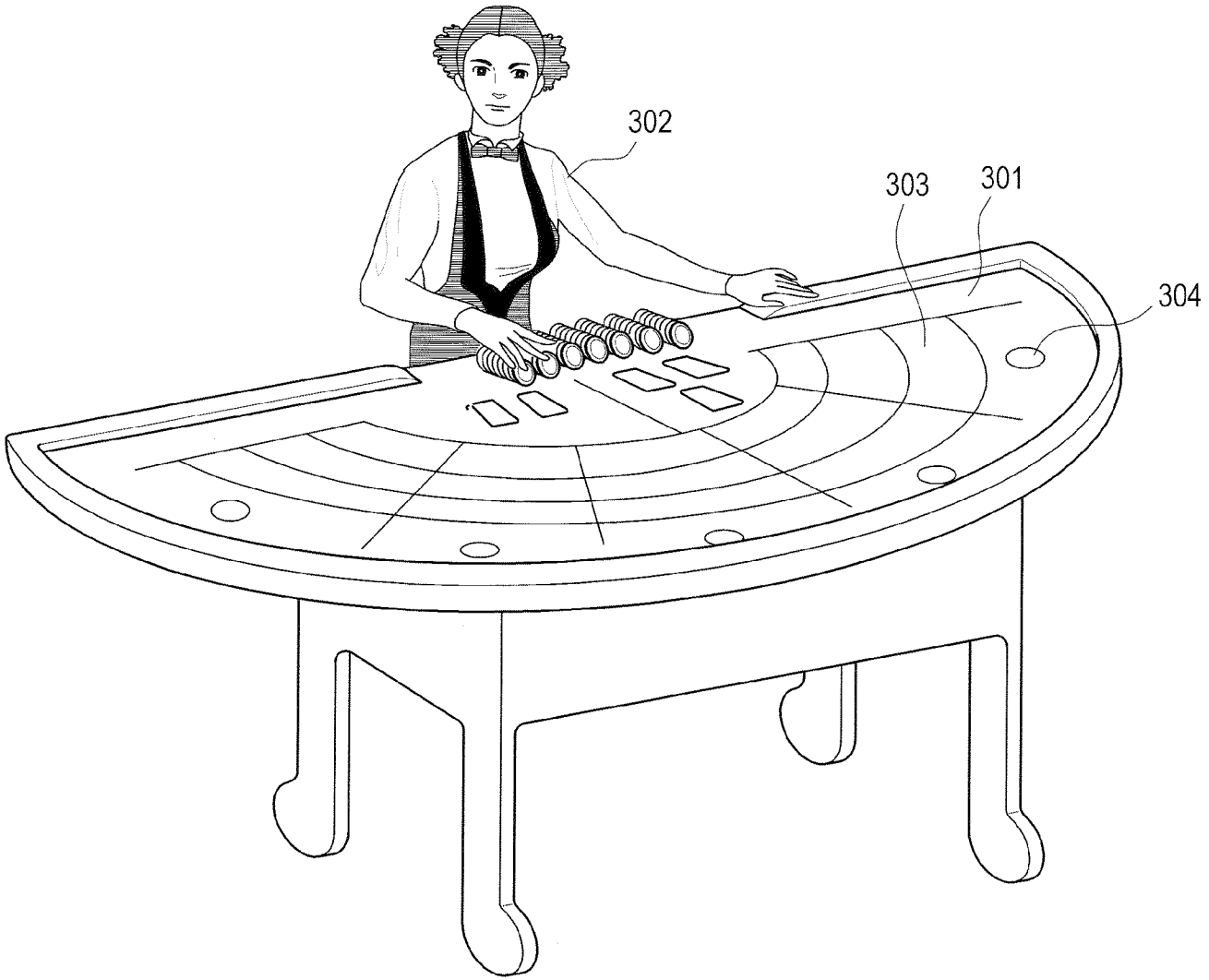
FIG. 14 is a schematic view of an exemplary application of the present invention to a table game.

In addition, the playing method of the card game according to the present invention can also be applied to Baccarat (so-called table game) played by the dealer 302 and the player (not shown) on a gaming table 301, as shown in FIG. 14.

In the table game shown in FIG. 14, the dealer 302 deals cards to the term "Banker" and the term "Player" respectively on the gaming table 301. The player places a bet by putting chips on a bet spot 303 of the gaming table 301. In this occasion, if chips are further put on a particular spot 304 adjacent to the bet spot 303, the dealer 302 determines that a bet-with-a-bonus operation has been performed. However, the dealer 302 may also determine that a bet-with-a-bonus operation has been performed if special chips are put on the bet spot 303.

Additionally, the dealer 302 plays Baccarat using a card deck including a plurality (for example, five) of cards which are marked with the mark 401 of "$" so as to execute as the bonus game subsequent to Baccarat for the player who performs a bet-with-a-bonus operation.

As described above, with the card gaming machine 1 and playing method of the card game according to the present embodiment, there are an ordinary bet operation using only the bet button 75 without using the bet-with-a-bonus button 201, and a bet-with-a-bonus operation using both the bet-with-a-bonus button 201 and the bet button 75, as the bet operation of Baccarat. In this regard, FIG. 13 is a table showing the difference between the ordinary bet operation and the bet-with-a-bonus operation.

If an ordinary bet operation is performed in Baccarat, the odds value is the ordinary value (1.95 times, 2 times, or 8 times) fixed and no bonus game will be executed subsequent to Baccarat as shown in FIG. 13.

If, on the other hand, a bet-with-a-bonus operation is performed in Baccarat, the odds value is fixed to the ordinary value (1.95 times, 2 times, or 8 times) ×0.7 or varied within the range of the ordinary value (1.95 times, 2 times, or 8 times) ×0.7 ×0.1 to the ordinary value (1.95 times, 2 times, or 8 times) ×0.7 ×1.0. Furthermore, the bonus game is executed subsequent to Baccarat, and a variable number of 100 to 500 credits or a fixed number of 500 credits will be awarded as a bonus payout to the winner of the bonus game. Here, an additional condition such that the player has to win for the player's bet in Baccarat may be posed in order to execute the bonus game subsequent to Baccarat.

What is claimed is:

1. A gaming machine comprising a display device for displaying cards which are dealt in a main game;

an input unit for allowing a player to enter instructions related to a progress of the main game;

an operation unit for allowing the player to indicate a number of bets of one of a first type and a second type for one of a term "Player", a term "Banker", and a term "Tie" in the main game;

a memory for storing a number of credits held by the player; and a processor programmed to execute the main game by executing processes of:

when the number of bets of the first type is indicated by an operation on the operation unit, (a) displaying, upon completion of allowing the player to indicate the number of bets using the operation unit, two cards which have been dealt as term player cards and two cards which have been dealt as term banker cards on the display device;

(b) respectively determining whether or not to deal one more card to the term player cards or the term banker cards, which have been displayed on the display device, according to a predefined rule;

(c) if it is determined to deal one more card to the term player cards which have been displayed on the display device, additionally displaying the dealt one more card as the term player cards on the display device;

(d) if it is determined to deal one more card to the term banker cards which have been displayed on the display device, additionally displaying the dealt one more card as the term banker cards on the display device;

(e) determining an outcome of the main game by one of the term "Player", the term "Banker", and the term "Tie", based on a combination of the two or three cards which have been displayed as the player card on the display device and a combination of the two or three cards which have been displayed as the banker card on the display device;

(f) determining whether or not the player wins for the number of bets, based on the determined outcome of the main game; and (g) if the player wins for the number of bets, adding a number of credits calculated using a predefined odds to the number of credits in the memory and storing the added sum, when, otherwise, the number of bets of the second type is indicated by an operation on the operation unit, (h) changing the predefined odds to a lower value than the predefined odds and;

(i) randomly determining whether or not to award a bonus to the player; and (j) if it is determined to award the bonus to the player, adding a number of credits according to the bonus to the number of credits in the memory and storing the added sum.

2. The gaming machine according to claim 1, wherein the processor is programmed to randomly determine whether or not to award the bonus to the player by executing processes of:

(a) using a card deck including at least one card, which is marked with a predefined mark;

(b) if the number of bets of the second type is indicated for the term "Player" by the operation on the operation unit, when the term player cards which consists of the two or three cards displayed on the display device, includes the card marked with the predefined mark, determining to award the bonus to the player;

(c) if the number of bets of the second type is indicated for the term "Banker" by the operation on the operation unit, when the term banker cards which consists of the two or three cards displayed on the display device, includes the card marked with the predefined mark, determining to award the bonus to the player; and (d) if the number of bets of the second type is indicated for the term "Tie" by an operation on the operation unit, when the term player cards which consists of the two or three cards displayed on the display device, includes the card marked with the predefined mark or if the term banker cards which consists of the two or three cards displayed on the display device, includes the card marked with the predefined mark, determining to award the bonus to the player.

3. A control method of a card gaming machine having a display device for displaying cards which are dealt in a main game and an operation unit for allowing a player to indicate a number of bets of one of a first type and a second type for one of a term "Player", a term "Banker", and a term "Tie" in the main game, the control method comprising, so as to make the main game proceed, steps of:

when the player indicates via the operation unit the number of bets of the first type for one of the term "Player", the term "Banker", and the term "Tie" in the main game, (a) dealing, upon completion of the player's indicating the number of bets, two cards displayed on the display device as term player cards and two cards displayed on the display device as term banker cards;

(b) respectively determining whether or not to deal one more card to the term player cards or the term banker cards, according to a predefined rule;

(c) if it is determined to deal one more card to the term player cards, additionally dealing one more card as the term player cards;

(d) if it is determined to deal one more card to the term banker cards, additionally dealing one more card as the term banker cards;

(e) determining an outcome of the main game by one of the term "Player", the term "Banker", and the term "Tie", based on a combination of the two or three cards which have been dealt as the player card and a combination of the two or three cards which have been dealt as the banker card;

(f) determining whether or not the player wins for the number of bets, based on the determined outcome of the main game; and (g) if the player wins for the number of bets, the number of credits calculated using a predefined odds are awarded to the player, and when, otherwise, the player indicates the number of bets of the second type for one of the term "Player", the term "Banker", and the term "Tie" in the main game, (h) changing the predefined odds to a lower value than the predefined odds;

(i) randomly determining whether or not to award a bonus to the player; and (j) if it is determined to award the bonus to the player, awarding the number of credits according to the bonus to the player.

4. The control method of a card gaming machine according to claim 3, further comprising the steps of:

(a) using a card deck including at least one card, which is marked with a predefined mark;

(b) if the player indicates the number of bets of the second type for the term "Player", when the term player cards which consists of the two or three cards, includes the card marked with the predefined mark, determining to award the bonus to the player;

(c) if the player indicates the number of bets of the second type for the term "Banker", when the term banker cards which consists of the two or three cards, includes the card marked with the predefined mark, determining to award the bonus to the player; and (d) if the player indicates the number of bets of the second type for the term "Tie", when the term player cards which consists of the two or three cards, includes the card marked with the predefined mark or when the term banker cards which consists of the two or three cards, includes the card marked with the predefined mark, determining to award the bonus to the player.

* * * * *